US010083647B2

(12) United States Patent
Lee et al.

(10) Patent No.: US 10,083,647 B2
(45) Date of Patent: Sep. 25, 2018

(54) GAMMA DATA GENERATOR, DISPLAY APPARATUS HAVING THE SAME AND METHOD OF DRIVING THE DISPLAY APPARATUS

(71) Applicant: Samsung Display Co., Ltd., Yongin, Gyeonggi-Do (KR)

(72) Inventors: Dong-Gyu Lee, Seoul (KR); Joon-Chul Goh, Hwaseong-si (KR); Sang-Ik Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 512 days.

(21) Appl. No.: 14/569,363

(22) Filed: Dec. 12, 2014

(65) Prior Publication Data

US 2016/0027370 A1 Jan. 28, 2016

(30) Foreign Application Priority Data

Jul. 22, 2014 (KR) ..... 10-2014-0092859

(51) Int. Cl.
*G09G 3/20* (2006.01)
*G09G 3/36* (2006.01)

(52) U.S. Cl.
CPC ..... *G09G 3/2074* (2013.01); *G09G 3/3637* (2013.01); *G09G 2320/0276* (2013.01); *G09G 2320/0673* (2013.01); *G09G 2320/106* (2013.01)

(58) Field of Classification Search
CPC ..... G09G 2320/106; G09G 2320/0673; G09G 2320/0276
See application file for complete search history.

(56) References Cited

U.S. PATENT DOCUMENTS 6,297,788 B1 * 10/2001 Shigeta ..... G09G 3/2018 345/589
2007/0126678 A1 * 6/2007 Shih ..... G09G 3/342 345/89
2008/0122813 A1 * 5/2008 Kim ..... G09G 3/3648 345/204
2009/0309903 A1 * 12/2009 Park ..... G09G 3/3611 345/690
2010/0091042 A1 4/2010 Inoue
(Continued)

FOREIGN PATENT DOCUMENTS

KR 1020140003146 A 1/2014
KR 1020150072254 A 6/2015

*Primary Examiner* — Amare Mengistu
*Assistant Examiner* — Shawna Stepp Jones
(74) *Attorney, Agent, or Firm* — H.C. Park & Associates, PLC

(57) ABSTRACT

A display apparatus includes a display panel comprising a data line, a gate line crossing the data line and a sub pixel connected to the data line and the gate line, a moving vector extractor configured to extract a moving vector of an input image using input data, a data generator configured to generate data of a high gamma curve called "high data" and data of a low gamma curve called "low data" corresponding to the input data using a spatiotemporal sequential pattern based on moving direction and moving speed of the moving vector, and a data driver circuit configured to covert the high data and the low data of the input data into a data voltage and provide the data line with the data voltage.

7 Claims, 8 Drawing Sheets

(56) References Cited

U.S. PATENT DOCUMENTS

| | | | | |
|---|---|---|---|---|
| 2010/0164996 | A1 | 7/2010 | Tomizawa et al. | |
| 2011/0298839 | A1* | 12/2011 | Nakanishi | G09G 3/3426 345/690 |

* cited by examiner

Gamma data generator(300)
DIN
Moving vector extractor (310)
MV
Data generator (330)
DOUT
DCS
Controller (200)
OS
Data driver circuit (400)
GCS
Gate driver circuit (500)
r
g
b
GL
SP
PU
DL
Display panel (100)
D2
D1

FIG. 3

| DIRECTION | SPEED(ppf) | OPTIMAL SEQUENTIAL PATTERN | |
|---|---|---|---|
| - | 0 | SP1 A B SP2<br>SP3 B A SP4 | TSP1 |
| md1(↑) | 0.5 | A B<br>A B | TSP2 |
| | 1 | A A<br>B B | TSP3 |
| md2(→) | 0.5 | A A<br>B B | TSP4 |
| | 1 | A A<br>B B | TSP5 |
| ⋮ | ⋮ | ⋮ | ⋮ |

F1 F2 F3 F4

A SEQUENCE: H → L → L → L

B SEQUENCE: L → L → H → L

< SEQUENTIAL PATTERN LUT>

| INPUT DATA (DIN) | OUTPUT DATA(DOUT) | |
|---|---|---|
| | HIGH DATA(H) | LOW DATA(L) |
| 0G | 0G | 0G |
| 32G | 64G | 0G |
| 63G | 109G | 0G |
| 95G | 157G | 0G |
| 127G | 213G | 44G |
| 159G | 239G | 77G |
| 191G | 251G | 149G |
| 223G | 253G | 209G |
| 255G | 255G | 255G |

<GAMMA LUT>

FIG. 6A

| Temporal Pattern | | | | |
|---|---|---|---|---|
| | 1st Frame (F1) | 2nd Frame (F2) | 3rd Frame (F3) | 4th Frame (F4) |
| A Seq. | H | L | L | L |
| B Seq. | L | L | H | L |

| Spatial Pattern (4x4 PUs) | | | | | | | | | | | | | |
|---|---|---|---|---|---|---|---|---|---|---|---|---|---|
| | | Column | | | | | | | | | | | |
| | | C1 | | | C2 | | | C3 | | | C4 | | |
| | | r | g | b | r | g | b | r | g | b | r | g | b |
| Row | R1 | A | B | A | B | A | B | A | B | A | B | A | B |
| | R2 | A | B | A | B | A | B | A | B | A | B | A | B |
| | R3 | A | B | A | B | A | B | A | B | A | B | A | B |
| | R4 | A | B | A | B | A | B | A | B | A | B | A | B |

TSP2

U

GAMMA DATA GENERATOR, DISPLAY APPARATUS HAVING THE SAME AND METHOD OF DRIVING THE DISPLAY APPARATUS

This application claims priority from and all the benefits under 35 U.S.C. § 119 of Korean Patent Application No. 10-2014-0092859, filed on Jul. 22, 2014 in the Korean Intellectual Property Office, which is hereby incorporated by reference for all purposes as if fully set forth herein.

BACKGROUND OF THE INVENTION

Field of the Invention

Exemplary embodiments of the inventive concept relate to a gamma data generator, a display apparatus having the gamma data generator and a method of driving the display apparatus. More particularly, example embodiments of the inventive concept relate to a gamma data generator for improving a display quality, a display apparatus having the gamma data generator and a method of driving the display apparatus.

Description of the Related Art

A liquid crystal display (LCD) panel may include a thin film transistor (TFT) substrate, an opposing substrate and an LC layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the backside of the LCD panel or from the front of the LCD panel. The LCD panel may have limited side visibility. To improve the side visibility, a multi-domain technique may be used. In the multi-domain technique, an area in which a pixel electrode is formed is divided into a plurality of domains, and LC molecules of the LC layer are arranged according to the domain in which they are located.

BRIEF SUMMARY OF THE INVENTION

Exemplary embodiments of the inventive concept provide a gamma data generator for improving a visibility.

Exemplary embodiments of the inventive concept provide a display apparatus having the gamma data generator.

Exemplary embodiments of the inventive concept provide a method of driving the display apparatus.

According to an exemplary embodiment of the inventive concept, there is provided a display apparatus. The display apparatus includes a display panel comprising a data line, a gate line crossing the data line and a sub pixel connected to the data line and the gate line, a moving vector extractor configured to extract a moving vector of an input image using input data, a data generator configured to generate data of a high gamma curve called "high data" and data of a low gamma curve called "low data" corresponding to the input data using a spatiotemporal sequential pattern based on moving direction and moving speed of the moving vector, and a data driver circuit configured to covert the high data and the low data of the input data into a data voltage to provide the data line with the data voltage.

In an exemplary embodiment, the data generator may include a sequential pattern look up table (LUT) configured to store a plurality of spatiotemporal sequential patterns corresponding to a plurality of moving directions and a plurality of moving speeds, a gamma LUT configured to store the high data corresponding to the input data based on the high gamma curve and the low data corresponding to the input data based on the low gamma curve, and an output controller configured to control the sequential pattern LUT and the gamma LUT based on the moving vector and to selectively output one of the high data and the low data corresponding to the input data.

In an exemplary embodiment, the spatiotemporal sequential pattern may include a spatial pattern which has an array of the high and low data corresponding to a plurality of sub pixels arranged in an (n×m) matrix array, and a temporal pattern which has a sequence of the high and low data corresponding to the sub pixels during k frames ('n', 'm' and 'k' are natural numbers).

In an exemplary embodiment, a measure of the moving speed may be a pixel per frame (ppf).

According to an exemplary embodiment of the inventive concept, there is provided a gamma data generator. The gamma data generator includes a moving vector extractor configured to extract a moving vector of an input image using input data, a sequential pattern look up table (LUT) configured to store a plurality of spatiotemporal sequential patterns corresponding to a plurality of moving directions and a plurality of moving speeds, a gamma LUT configured to store the high data corresponding to the input data based on the high gamma curve and the low data corresponding to the input data based on the low gamma curve, an output controller configured to control the sequential pattern LUT and the gamma LUT based on the moving vector and to selectively output one of the high data and the low data corresponding to the input data.

In an exemplary embodiment, the spatiotemporal sequential pattern may include a spatial pattern which has an array of the high and low data corresponding to a plurality of sub pixels arranged in an (n×m) matrix array, and a temporal pattern which has a sequence of the high and low data corresponding to the sub pixels during k frames ('n', 'm' and 'k' are natural numbers).

In an exemplary embodiment, a measure of the moving speed may be a pixel per frame (ppf).

According to an exemplary embodiment of the inventive concept, there is provided a method of a display apparatus. The method includes extracting a moving vector of an input image using input data, generating high data of a high gamma curve and low data of a low gamma curve corresponding to the input data using a spatiotemporal sequential pattern based on moving direction and moving speed of the moving vector, and converting the high data and the low data of the input data into a data voltage to provide a data line of a display panel with the data voltage.

In an exemplary embodiment, the high data and the low data of the input data may be generated using a sequential pattern look up table (LUT) configured to store a plurality of spatiotemporal sequential patterns corresponding to a plurality of moving directions and a plurality of moving speeds and a gamma LUT configured to store the high data and the low data corresponding to the input data.

In an exemplary embodiment, the spatiotemporal sequential pattern may include a spatial pattern which has an array of the high and low data corresponding to a plurality of sub pixels arranged in an (n×m) matrix array, and a temporal pattern which has a sequence of the high and low data corresponding to the sub pixels during k frames ('n', 'm' and 'k' are natural numbers).

According to the inventive concept, the moving vector of the input data is extracted, the spatiotemporal sequential pattern which is optimized for reducing or removing the Moving Artifact in the moving direction and the moving speed corresponding to the moving vector is determined and the high and low gamma curves are applied to the input data in both time division method and space division method based on the spatiotemporal sequential pattern to generate the gamma data of the input data. Thus, the display quality of the display image may be improved.

BRIEF DESCRIPTION OF THE DRAWINGS

The above and other features and advantages of the inventive concept will become more apparent by describing in detailed exemplary embodiments thereof with reference to the accompanying drawings, in which:

FIG. 3 is conceptual diagram illustrating a sequential pattern look up table (LUT) of FIG. 2 according to an exemplary embodiment;

FIGS. 6A to 6C are conceptual diagrams illustrating the method of FIG. 5.

DETAILED DESCRIPTION OF THE INVENTION

Hereinafter, the inventive concept will be explained in detail with reference to the accompanying drawings.

Figure 1:
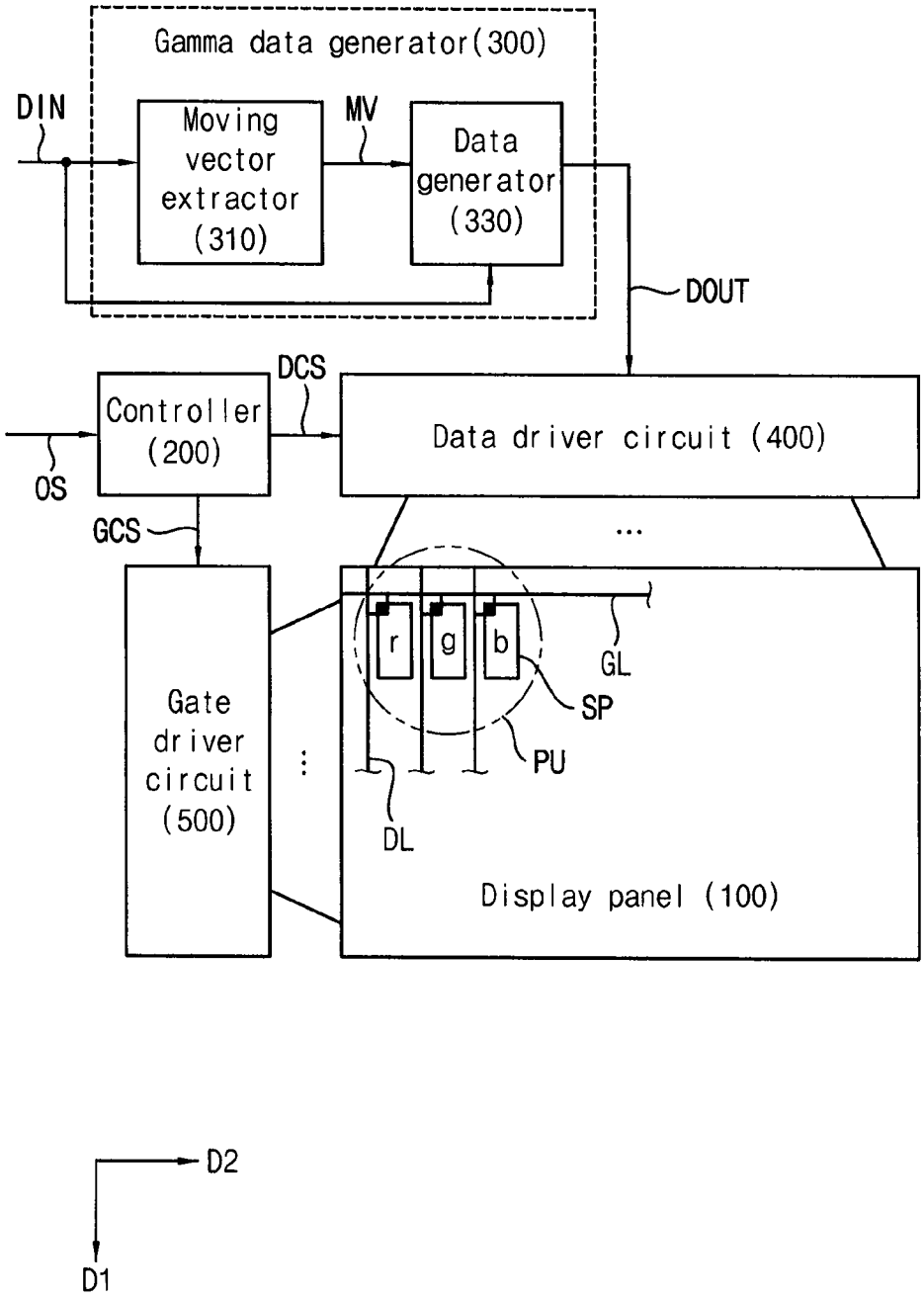
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus may include a display panel 100, a controller 200, a gamma data generator 300, a data driver circuit 400 and a gate driver circuit 500.

The display panel 100 may include a plurality of data lines DL, a plurality of gate lines GL and a plurality of pixel units PU. The data lines DL extend in a first direction D1 and are arranged in a second direction D2 crossing the first direction D1. The gate lines GL extend in the second direction D2 and are arranged in the first direction D1. The pixel units PU are arranged as a matrix array which includes a plurality of pixel rows and a plurality of pixel columns. Each of the pixel units PU may include a plurality of sub pixels SP. For example, the pixel unit PU includes a red sub pixel r, a green sub pixel g and a blue sub pixel b.

The controller 200 generally controls an operation of the display apparatus. The controller 200 is configured to receive an original synch signal OS, and to generate a plurality of control signals for driving the display panel 100 based on the original synch signal OS. The control signals may include a data control signal DCS for controlling the data driver circuit 400 and a gate control signal GCS for controlling the gate driver circuit 400.

The data control signal DCS may include a horizontal synch signal, a vertical synch signal, a data enable signal, a polarity control signal and so on. The gate control signal GCS may include a vertical start signal, a gate clock signal, an output enable signal and so on.

The gamma data generator 300 may include a moving vector extractor 310 and a data generator 330.

The moving vector extractor 310 is configured to extract a moving vector MV of an object included in an input image using input data DIN. For example, the moving vector extractor 310 is configured to compare current frame data with previous frame data and to extract the moving vector MV of the moving object included in a current frame image. The moving vector MV may be calculated by various algorithms such as a Motion Estimation Motion Compensation (MEMC) algorithm.

The data generator 330 is configured to determine a spatiotemporal sequential pattern which is optimized for reducing or removing a Moving Artifact based on a moving direction and a moving speed of the moving vector MV, to apply a high gamma curve and a low gamma curve to the input data DIN in both time division method and space division method based on the determined spatiotemporal sequential pattern, and to generate gamma data DOUT.

The spatiotemporal sequential pattern includes a spatial pattern which has a preset array of high data of the high gamma curve and low data of the low gamma curve corresponding to a plurality of sub pixels arranged in an (n×m) matrix array, and a temporal pattern which has a preset sequence of the high and the low data corresponding to the sub pixels during k frames ('n', 'm' and 'k' are natural numbers).

When an observer's eyes observe the image along the moving direction of the moving object, a Moving Artifact is observed in a side of the moving object such as a Checker defect. The observed Moving Artifact may be different according to the moving direction and the moving speed of the moving object.

According to an exemplary embodiment, the gamma data generator 300 is configured to extract the moving vector including the moving direction and the moving speed of the moving object and to determine a spatiotemporal sequential pattern which is optimized for reducing or removing a Moving Artifact based on the moving vector MV such that the display quality of the display image may be improved.

The data driver circuit 400 is configured to convert the gamma data DOUT received from the gamma data generator 300 into a data voltage for driving the sub pixel of the display panel 100 and to output the data voltage to the data line DL.

The gate driver circuit 500 is configured to generate a plurality of gate signals and to sequentially output the gate signals to the gate lines GL of the display panel 100.

Figure 2:
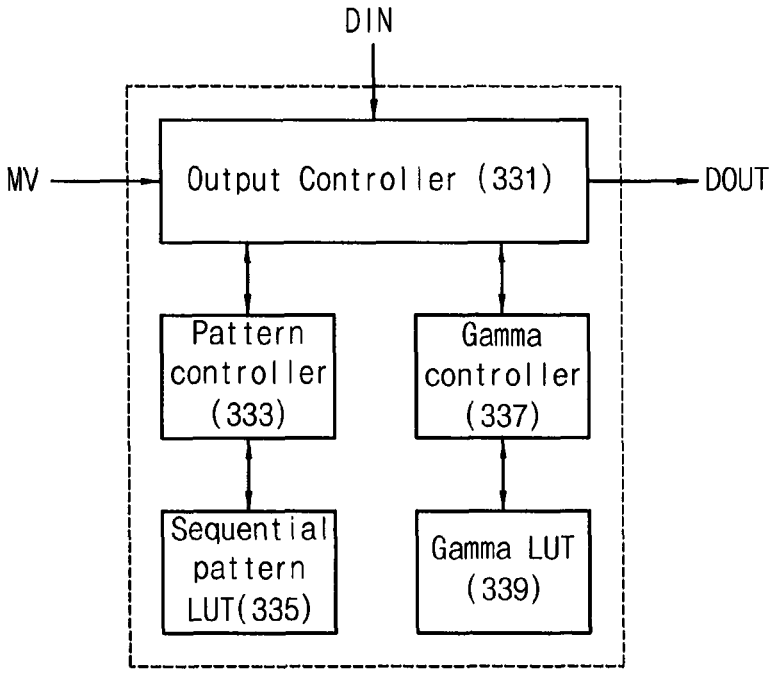
FIG. 2 is a block diagram illustrating a data generator of FIG. 1.

FIG. 2 is a block diagram illustrating a data generator of FIG. 1.

Referring to FIG. 2, the data generator 330 may include an output controller 331, a pattern controller 333, a sequential pattern look up table (LUT) 335, a gamma controller 337 and a gamma LUT 339.

The output controller 331 is configured to receive the moving vector MV, and to provide the pattern controller 333 with the moving direction and the moving speed corresponding to the moving vector MV.

The pattern controller 333 is configured to control the sequential pattern LUT 335 and to determine an optimal spatiotemporal sequential pattern such that in the moving direction and the moving speed corresponding to the moving vector MV, the Moving Artifact is not observed. The pattern controller 333 is configured to provide the output controller 331 with the spatiotemporal sequential pattern.

The sequential pattern LUT 335 is configured to store a plurality of spatiotemporal sequential patterns corresponding to a plurality of moving directions and a plurality of moving speeds. Each of the spatiotemporal sequential patterns is optimized for reducing or removing the Moving Artifact in corresponding moving direction and moving speed. The optimum spatiotemporal sequential patterns are experimented data.

The gamma controller 337 is configured to control the gamma LUT 339 based on the spatiotemporal sequential pattern provided from the output controller 331 and to selectively read out one of the high data H of the high gamma curve and the low data L of the low gamma curve corresponding to the input data DIN from the gamma LUT 339. The output controller 331 is configured to output one of the high data H and the low data L provided from the gamma controller 337 as the gamma data DOUT of the input data DIN.

The gamma LUT 339 is configured to store a grayscale level of the high data H based on the high gamma curve and a grayscale level of the low data L based on the low gamma curve corresponding to a grayscale level of the input data DIN.

Figures 4A, 4B:
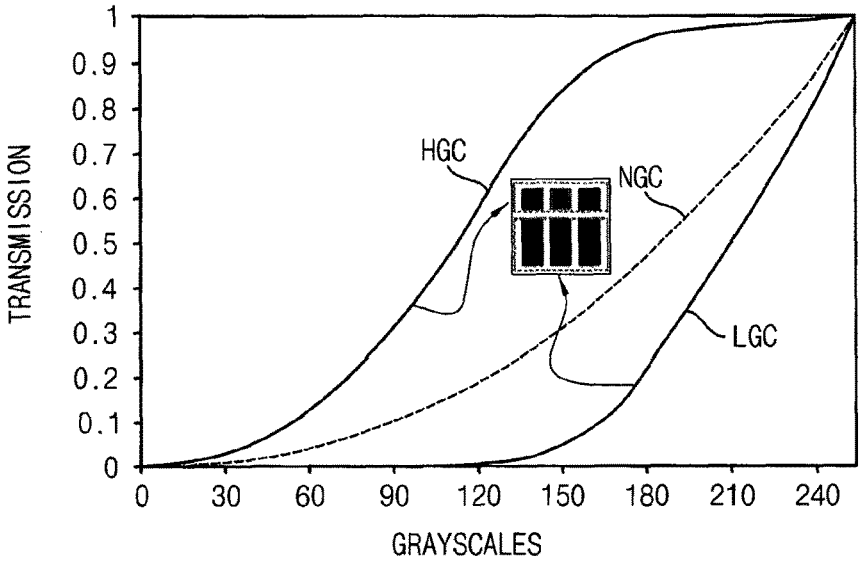
FIG. 4A is a conceptual diagram illustrating a gamma curve of FIG. 2 according to an exemplary embodiment.
FIG. 4B is conceptual diagram illustrating a gamma look up table (LUT) of FIG. 2 according to an exemplary embodiment, based on the gamma curve in FIG. 4A.

FIG. 3 is conceptual diagram illustrating a sequential pattern look up table (LUT) of FIG. 2 according to an exemplary embodiment. FIG. 4A is a conceptual diagram illustrating a gamma curve of FIG. 2 according to an exemplary embodiment; FIG. 4B is conceptual diagram illustrating a gamma look up table (LUT) of FIG. 2 according to an exemplary embodiment, based on the gamma curve in FIG. 4A.

Referring to FIGS. 2 and 3, the sequential pattern LUT 335 is configured to store a plurality of spatiotemporal sequential patterns TSP1, TSP2, TSP3, TSP4 and TSP5 corresponding to a plurality of moving directions and a plurality of moving speeds.

For example, a first spatiotemporal sequential pattern TSP1 corresponds to an image which does not have moving direction and moving speed. The first spatiotemporal sequential pattern TSP1 includes a first spatial pattern which has a spatial array of sub pixels SP1, SP2, SP3 and SP4 arranged in a (2×2) matrix array and a first temporal pattern which has a temporal sequence of the high and low data respectively corresponding to the sub pixels SP1, SP2, SP3 and SP4 during a plurality of frames, for example, 4 frames. A temporal pattern includes a first sequence A and a second sequence B.

In the first spatiotemporal sequential pattern TSP1, the first and fourth sub pixels SP1 and SP4 which are arranged in a first diagonal direction having the first sequence A and the second and third sub pixels SP2 and SP3 which are arranged in a second diagonal direction having the second sequence B.

Each of the first and second sequences A and B has a preset sequence with respect to the high data H of the high gamma curve and the low data L of the low gamma curve.

The gamma data DOUT of a sub pixel having the first sequence A has a sequence as "H→L→L→L" during 4 frames with respect to the high data H of the high gamma curve and the low data L of the low gamma curve. According to the first sequence A, the gamma data DOUT of the sub pixel are determined as the high data H during a first frame F1 and the gamma data DOUT of the sub pixel are determined as the low data L during second, third and fourth frames F2, F3 and F4, respectively.

The gamma data DOUT of a sub pixel having the second sequence B has a sequence as "L→L→H→L" during 4 frames with respect to the high data H of the high gamma curve and the low data L of the low gamma curve. According to the second sequence B, the gamma data DOUT of the sub pixel are determined as the low data L during a first frame F1, are determined as the low data L during a second frame F2, are determined as the high data H during a third frame F3 and are determined as the low data L during a fourth frame F4.

Referring to FIGS. 4A and 4B, in comparison with a normal gamma curve NGC, the high gamma curve HGC has a relatively high luminance in mid grayscales and the low gamma curve LGC has a relatively low luminance in mid grayscales. The grayscale level of the high data H has a transmission based on the high gamma curve HGC and the grayscale level of the low data L has a transmission based on the low gamma curve LGC.

The gamma LUT is configured to store the grayscale level of the high data H and the grayscale level of the low data L corresponding to the grayscale level of the input data DIN.

For example, when the grayscale level of the input data DIN is a 63-grayscale level 63G, the grayscale level of the high data H based on the high gamma curve HGC may be a 109-grayscale level 109G and the grayscale level of the low data L based on the low gamma curve LGC may be a 0-grayscale level 0G as shown in FIG. 4B.

Therefore, when the gamma data DOUT of the input data that are the 63-grayscale level 63G are determined as the low data L based on the spatiotemporal sequential pattern, the gamma data DOUT of the input data are outputted as the 0-grayscale level 0G. Alternatively, the gamma data DOUT corresponding to the input data that is the 63-grayscale level 63G are determined as the high data H based on the spatiotemporal sequential pattern, the gamma data DOUT of the input data are outputted as the 109-grayscale level 109G.

For example, when the moving direction of the input data DIN is a first moving direction md1 and the moving speed of the input data DIN is a first moving speed 0.5 ppf (pixel per frame), the gamma data DOUT of the input data DIN are outputted based on a second spatiotemporal sequential pattern TSP2. The second spatiotemporal sequential pattern TSP2 includes a second spatial pattern which has a spatial array of sub pixels SP1, SP2, SP3 and SP4 arranged in a (2×2) matrix array and a second temporal pattern which has a temporal sequence of the high and low data respectively corresponding to the sub pixels SP1, SP2, SP3 and SP4 during a plurality of frames. In the second spatiotemporal sequential pattern TSP2, the first and third sub pixels SP1 and SP3 which are arranged in a first column direction have the first sequence A and the second and fourth sub pixels SP2, SP4 which are arranged in a second column direction have the second sequence B.

As described above, the sequential pattern LUT 335 is configured to store the spatiotemporal sequential pattern which is optimized for reducing or removing the Moving Artifact in corresponding moving direction and moving speed based on the moving vector.

Figure 5:
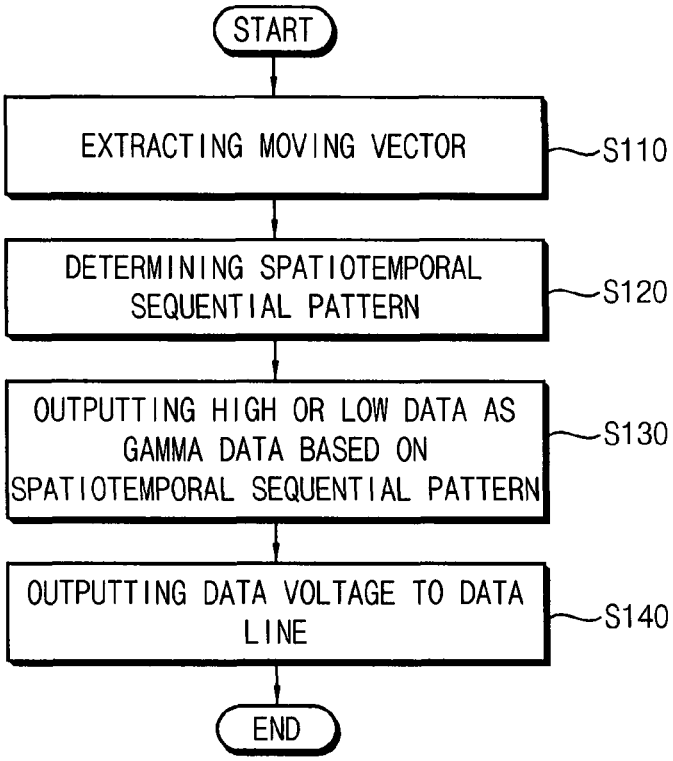
FIG. 5 is a flowchart illustrating a method of driving a display apparatus according to an exemplary embodiment.
Figure 6B:
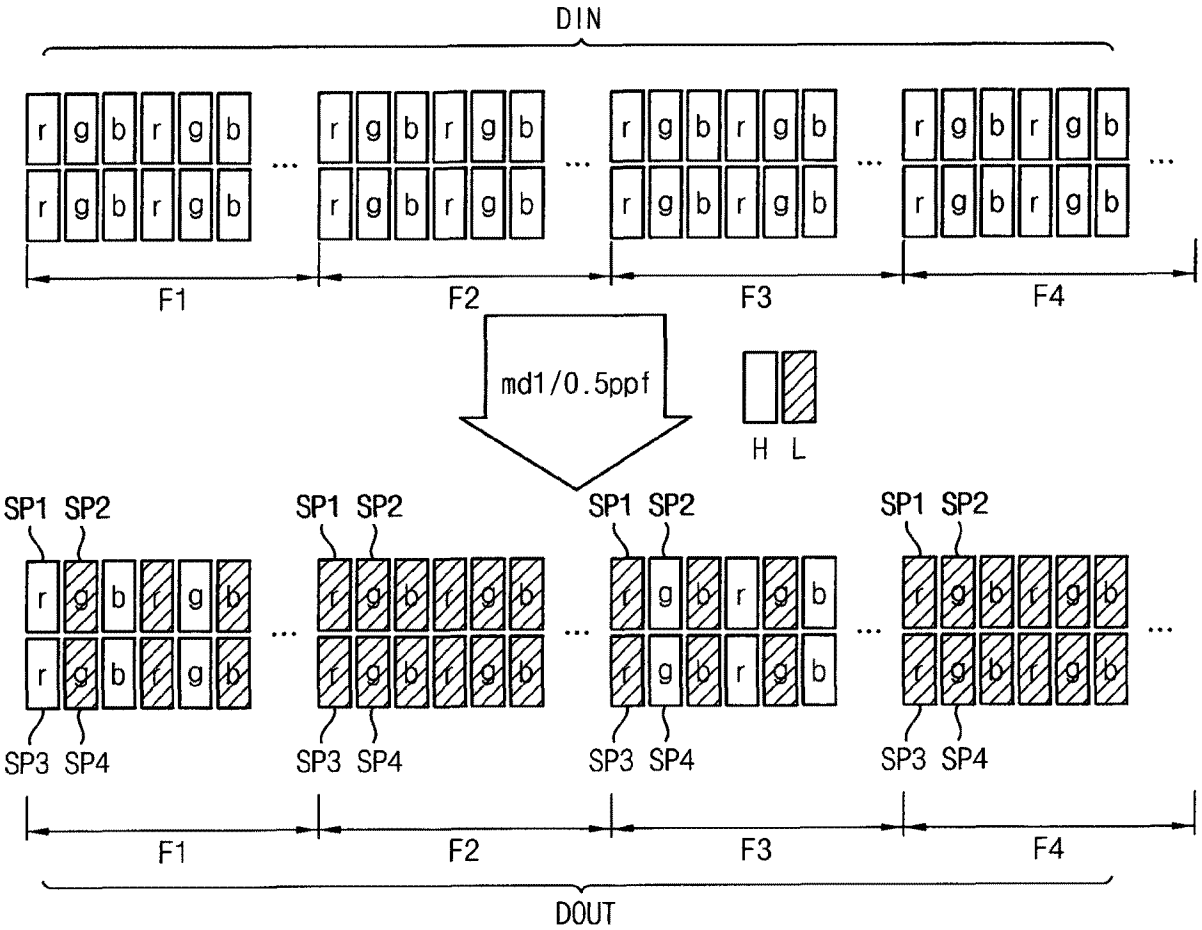
Figure 6C:
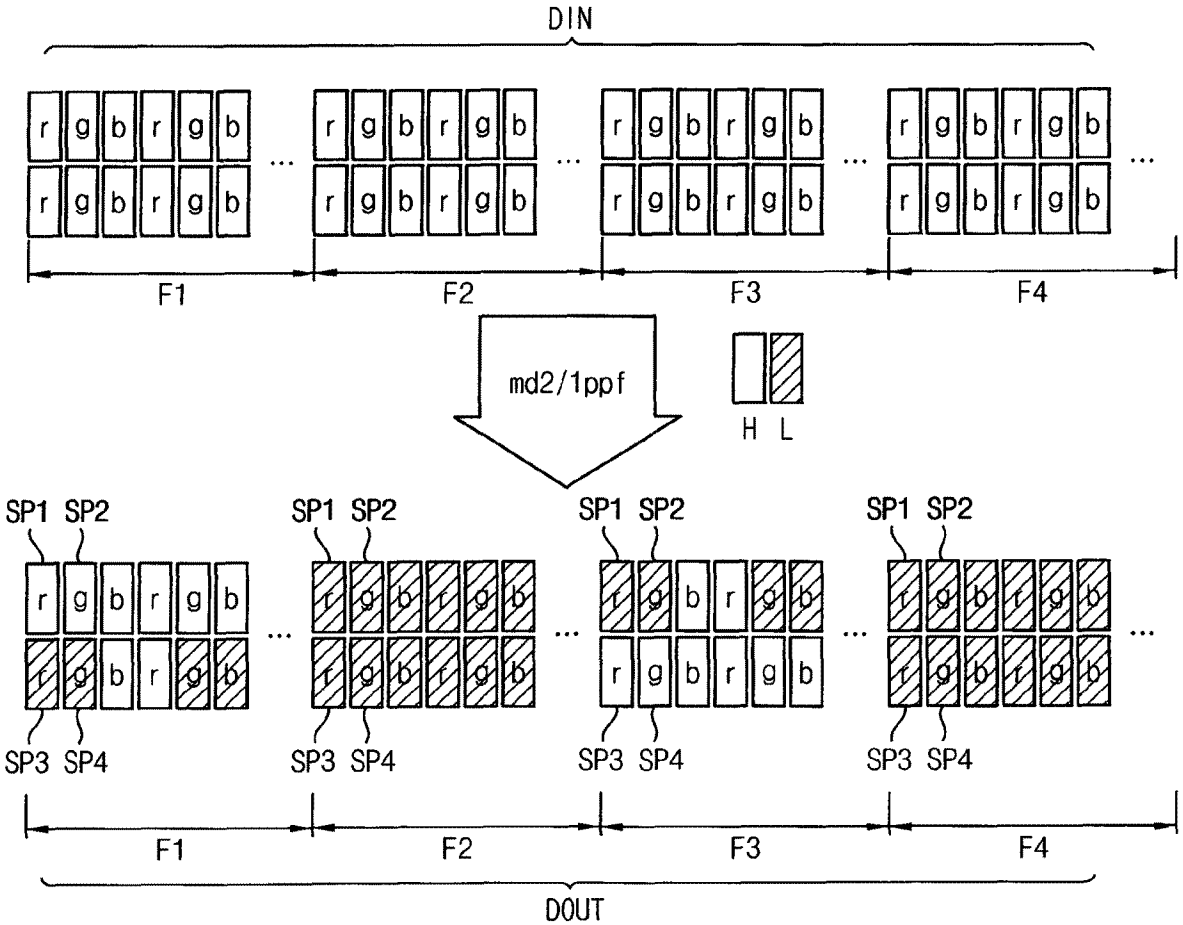

FIG. 5 is a flowchart illustrating a method of driving a display apparatus according to an exemplary embodiment. FIGS. 6A to 6C are conceptual diagrams illustrating the method of FIG. 5.

Referring to FIGS. 1, 2 and 5, the moving vector extractor 310 is configured to extract a moving vector MV of a moving object included in an input image using input data DIN (Step S110). For example, the moving vector extractor 310 may be configured to compare current frame data with at least one previous frame data and to extract the moving vector MV of the moving object included in a current frame image.

The output controller 331 is configured to receive the moving vector MV, and provide the pattern controller 333 with the moving direction and the moving speed corresponding to the moving vector MV. The pattern controller 333 is configured to control the sequential pattern LUT 335 and to determine a spatiotemporal sequential pattern which is optimized for reducing ore removing the Moving Artifact in the moving direction and the moving speed corresponding to the moving vector MV (Step S120).

For example, referring to FIGS. 3 and 6A, when the moving direction is the first moving direction md1 and the moving speed is the first moving speed (0.5 ppf), the pattern controller 333 is configured to select the second spatiotemporal sequential pattern TSP2 from the sequential pattern LUT.

The second spatiotemporal sequential pattern TSP2 includes a second temporal pattern (Temporal pattern) and a second spatial pattern (Spatial pattern) as shown in FIG. 6A.

The temporal pattern includes a first sequence A and a second sequence B. The first sequence A has a sequence as "H→L→L→L" during 4 frames. The second sequence B has a sequence as "L→L→H→L" during 4 frames.

The spatial pattern has a spatial array of sub pixels SP1, SP2, SP3 and SP4 arranged in a (2×2) matrix array. The first and third sub pixels SP1 and SP3 which are arranged in a first column direction have the first sequence A and the second and fourth sub pixels SP2 and SP4 which are arranged in a second column direction have the second sequence B.

As shown in FIG. 6A, the second spatial pattern (Spatial pattern) may have a spatial array U of sub pixels arranged in a (4×12) matrix array for increasing driving-efficiency.

The gamma controller 337 is configured to control the gamma LUT 339 based on the spatiotemporal sequential pattern provided from the output controller 331 and to selectively read out one of the high data of the high gamma curve and the low data of the low gamma curve corresponding to the input data DIN from the gamma LUT 339 (Step S130). The output controller 331 is configured to output one of the high data and the low data provided from the gamma controller 337 into the gamma data DOUT of the input data DIN.

For example, referring to FIG. 6B, when the second spatiotemporal sequential pattern TSP2 is determined based on the moving direction and the moving speed, the output controller 331 outputs the grayscale levels of the high data H as the gamma data DOUT of the first and third sub pixels SP1 and SP3 and outputs the grayscale levels of the low data L as the gamma data DOUT of the second and fourth sub pixels SP2 and SP4, during a first frame F1.

Then, during a second frame F2, the output controller 331 outputs the grayscale levels of the low data L as the gamma data DOUT of the first to fourth sub pixels SP1, SP2, SP3 and SP4.

Then, during a third frame F3, the output controller 331 outputs the grayscale levels of the low data L as the gamma data DOUT of the first and third sub pixels SP1 and SP3 and outputs the grayscale levels of the high data H as the gamma data DOUT of the second and fourth sub pixels SP2 and SP4.

Then, during a fourth frame F4, the output controller 331 outputs the grayscale levels of the low data L as the gamma data DOUT of the first to fourth sub pixels SP1, SP2, SP3 and SP4.

Referring to FIGS. 3 and 6C, when the moving direction is a second moving direction md2 and the moving speed is a second moving speed (1 ppf), the pattern controller 333 is configured to select a fifth spatiotemporal sequential pattern TSP5 from the sequential pattern LUT.

The gamma controller 337 is configured to control the gamma LUT 339 based on the fifth spatiotemporal sequential pattern TSP5 provided from the output controller 331 and to selectively read out one of the high data H of the high gamma curve and the low data L of the low gamma curve corresponding to the input data DIN from the gamma LUT 339.

For example, referring to FIG. 6C, during first frame F1, the output controller 331 outputs the grayscale levels of the high data H as the gamma data DOUT of the first and second sub pixels SP1 and SP2 and outputs the grayscale levels of the low data L as the gamma data DOUT of the third and fourth sub pixels SP3 and SP4.

Then, during a second frame F2, the output controller 331 outputs the grayscale levels of the low data L as the gamma data DOUT of the first to fourth sub pixels SP1, SP2, SP3 and SP4.

Then, during a third frame F3, the output controller 331 outputs the grayscale levels of the low data L as the gamma data DOUT of the first and second sub pixels SP1 and SP2 and outputs the grayscale levels of the high data H as the gamma data DOUT of the third and fourth sub pixels SP3 and SP4.

Then, during a fourth frame F4, the output controller 331 outputs the grayscale levels of the low data L as the gamma data DOUT of the first to fourth sub pixels SP1, SP2, SP3 and SP4.

As described above, the sequential pattern LUT 335 is configured to store optimum spatiotemporal sequential pattern optimized so that in corresponding moving direction and moving speed based on the moving vector, the Moving Artifact is not observed.

The data driver circuit is configured to convert the gamma data DOUT received from the data generator 330 into a data voltage and to output the data voltage to the data line of the display panel (Step S140).

As described above, according to exemplary embodiments, the moving vector of the input data is extracted, the spatiotemporal sequential pattern which is optimized for reducing or removing the Moving Artifact in the moving direction and the moving speed corresponding to the moving vector determined and the high and low gamma curves are applied to the input data in both time division method and space division method based on the spatiotemporal sequential pattern to generate the gamma data of the input data. Thus, the display quality of the display image may be improved.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display panel comprising a data line, a gate line crossing the data line and a sub pixel connected to the data line and the gate line;

a moving vector extractor configured to extract a moving vector of an input image using input data;

a data generator configured to generate data of a high gamma curve called "high data" and data of a low gamma curve called "low data" corresponding to the input data using a spatiotemporal sequential pattern based on moving direction and moving speed of the moving vector; and a data driver circuit configured to convert the high data and the low data of the input data into a data voltage to provide the data line with the data voltage, wherein the spatiotemporal sequential pattern comprises a spatial pattern which has an array of the high and low data corresponding to a plurality of sub pixels arranged in an n×m matrix array, wherein a temporal pattern which has a sequence of the high and low data corresponding to the sub pixels during k frames, wherein n, m, and k are natural numbers, and wherein the temporal pattern comprises a first pattern sequentially comprising the high data, the low data, the low data, and the low data in four consecutive frames and a second pattern sequentially comprising the low data, the low data, the high data, and the low data in the four consecutive frames.

2. The display apparatus of claim 1, wherein the data generator comprises:

a sequential pattern look up table (LUT) configured to store a plurality of spatiotemporal sequential patterns corresponding to a plurality of moving directions and a plurality of moving speeds;

a gamma LUT configured to store the high data corresponding to the input data based on the high gamma curve and the low data corresponding to the input data based on the low gamma curve; and an output controller configured to control the sequential pattern LUT and the gamma LUT based on the moving vector and to selectively output one of the high data and the low data corresponding to the input data.

3. The display apparatus of claim 1, wherein a measure of the moving speed is a pixel per frame (ppf).

4. A gamma data generator comprising:

a moving vector extractor configured to extract a moving vector of an input image using input data;

a sequential pattern look up table (LUT) configured to store a plurality of spatiotemporal sequential patterns corresponding to a plurality of moving directions and a plurality of moving speeds;

a gamma LUT configured to store the high data corresponding to the input data based on the high gamma curve and the low data corresponding to the input data based on the low gamma curve; and an output controller configured to control the sequential pattern LUT and the gamma LUT based on the moving vector and to selectively output one of the high data and the low data corresponding to the input data, wherein the spatiotemporal sequential pattern comprises a spatial pattern which has an array of the high and low data corresponding to a plurality of sub pixels arranged in an n×m matrix array, wherein a temporal pattern which has a sequence of the high and low data corresponding to the sub pixels during k frames, wherein n, m, and k are natural numbers, and wherein the temporal pattern comprises a first pattern sequentially comprising the high data, the low data, the low data, and the low data in four consecutive frames and a second pattern sequentially comprising the low data, the low data, the high data, and the low data in the four consecutive frames.

5. The gamma data generator of claim 4, wherein a measure of the moving speed is a pixel per frame (ppf).

6. A method of a display apparatus comprising:

extracting a moving vector of an input image using input data;

generating high data of a high gamma curve and low data of a low gamma curve corresponding to the input data using a spatiotemporal sequential pattern based on moving direction and moving speed of the moving vector; and converting the high data and the low data of the input data into a data voltage to provide a data line of a display panel with the data voltage, wherein the spatiotemporal sequential pattern comprises a spatial pattern which has an array of the high and low data corresponding to a plurality of sub pixels arranged in an n×m matrix array, wherein a temporal pattern which has a sequence of the high and low data corresponding to the sub pixels during k frames, wherein n, m, and k are natural numbers, and wherein the temporal pattern comprises a first pattern sequentially comprising the high data, the low data, the low data, and the low data in four consecutive frames and a second pattern sequentially comprising the low data, the low data, the high data, and the low data in the four consecutive frames.

7. The method of claim 6, wherein the high data and the low data of the input data is generated using a sequential pattern look up table (LUT) configured to store a plurality of spatiotemporal sequential patterns corresponding to a plurality of moving directions and a plurality of moving speeds and a gamma LUT configured to store the high data and the low data corresponding to the input data.

* * * * *